US009132631B2

(12) United States Patent
Kobayashi

(10) Patent No.: US 9,132,631 B2
(45) Date of Patent: Sep. 15, 2015

(54) PRINTING APPARATUS AND PRINT TIMING CONTROL METHOD

(71) Applicant: CANON KABUSHIKI KAISHA, Tokyo (JP)

(72) Inventor: Tomoki Kobayashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/297,834

(22) Filed: Jun. 6, 2014

(65) Prior Publication Data

US 2014/0368567 A1 Dec. 18, 2014

(30) Foreign Application Priority Data

Jun. 18, 2013 (JP) ..... 2013-127786

(51) Int. Cl.
*B41J 29/393* (2006.01)
*B41J 2/07* (2006.01)
*B41J 19/20* (2006.01)

(52) U.S. Cl.
CPC . *B41J 2/07* (2013.01); *B41J 19/205* (2013.01)

(58) Field of Classification Search
CPC ..... B41J 29/3935; B41J 2/125; B41J 2/0451; B41J 2/2142; B41J 11/0095; B41J 2/2146; B41J 2/01; B41J 2/04505; B41J 11/41; B41J 2/2139; B41J 2/04581
See application file for complete search history.

(56) References Cited

U.S. PATENT DOCUMENTS 7,771,000 B2 * 8/2010 Iesaki ..... 347/19
8,186,792 B2 5/2012 Otani

FOREIGN PATENT DOCUMENTS

JP 2007-118425 A 5/2007

* cited by examiner

*Primary Examiner* — Lamson Nguyen
(74) *Attorney, Agent, or Firm* — Fitzpatrick, Cella, Harper & Scinto

(57) ABSTRACT

There is provided a printing apparatus that can perform print timing control while moving a print head with high precision even when variation in moving speed of the print head is relatively large. More specifically, a prediction speed is obtained based on a detected moving speed of the print head and a control target speed at the time of detection, and then a print timing of the print head is controlled based on the prediction speed. Accordingly, a correction speed of the print timing is considered to be the obtained prediction speed. This makes it possible to minimize a landing error even when a speed variation is large.

13 Claims, 13 Drawing Sheets

| CURRENT SPEED | TARGET SPEED | ELAPSED TIME | PREDICTION SPEED |
|---|---|---|---|
| 10 | 20 | 1 | 13 |
| 10 | 20 | 2 | 15 |
| 10 | 20 | 3 | 16 |
| 10 | 20 | 4 | 17 |
| 10 | 20 | 5 | 17 |
| ... | ... | ... | ... |
| 10 | 20 | 10 | 20 |

FIG.12

PRINTING APPARATUS AND PRINT TIMING CONTROL METHOD

BACKGROUND OF THE INVENTION

1. Field of the Invention

The present invention relates to a printing apparatus and a print timing control method, and more specifically to print timing control in printing while moving a print head.

2. Description of the Related Art

As one mode for controlling a print timing in a printing apparatus which performs printing while moving a print head, there is provided a printing apparatus that detects information about a moving speed of the print head by an encoder or the like and controls a print timing based on the information. The printing apparatus which performs printing not only in constant-speed control but also in acceleration/deceleration control performs print timing control according to a variable speed so that a desirable print position is obtained even when the speed of the print head is variable. Furthermore, the moving speed of the print head may change for some reason even in the constant-speed control, and thus the printing apparatus performs the print timing control in response to the speed variation.

Japanese Patent Laid-Open No. 2007-118425 discloses estimating for each detection cycle of an encoder a moving speed of a cycle by using a moving speed obtained in a previous cycle and determining a print timing of the cycle based on the estimation. More specifically, an estimated speed of a cycle is set based on a result obtained by subtracting a difference between the detected speed of the last cycle but one and the detected speed of the last cycle from the detected speed of the last cycle, and a print timing is controlled based on the estimated speed.

However, as disclosed in Japanese Patent Laid-Open No. 2007-118425, in a mode that the moving speed of the print head in a certain cycle is obtained based on the detected speed of the previous cycle, if the moving speed of the print head changes relatively larger, the difference between an estimated speed and an actual speed of the print head is greater. As a result, there is a problem that if the variation in moving speed of the print head is large, the difference between a target print position and an actual print position is large.

SUMMARY OF THE INVENTION

An object of the present invention is to provide a printing apparatus and a print timing control method that can perform print timing control while moving a print head with high precision even when variation in moving speed of the print head is relatively large.

In a first aspect of the present invention, there is provided a printing apparatus for performing printing by moving a print head relative to a print medium, the printing apparatus comprising: a detection unit configured to detect a moving speed of the print head; a driving control unit configured to control a driving mechanism for driving the print head based on the detected moving speed of the print head and a target speed so that the print head moves at a moving speed that is made closer to the target speed; and a timing control unit configured to obtain a prediction speed based on the detected moving speed and the target speed and control a print timing of the print head based on the prediction speed.

In a second aspect of the present invention, there is provided a print timing control method for performing printing by moving a print head relative to a print medium, the print timing control method comprising: a detection step for detecting a moving speed of the print head; a driving control step for controlling a driving mechanism for driving the print head based on the detected moving speed of the print head and a target speed so that the print head moves at a moving speed that is made closer to the target speed; and a timing control step for obtaining a prediction speed based on the detected moving speed and the target speed and control a print timing of the print head based on the prediction speed.

The above structure makes it possible to perform the print timing control while moving the print head with high precision even when variation in moving speed of the print head is relatively large.

Further features of the present invention will become apparent from the following description of exemplary embodiments (with reference to the attached drawings).

BRIEF DESCRIPTION OF THE DRAWINGS

FIG. 12 shows an exemplary look-up table for obtaining a prediction speed.

DESCRIPTION OF THE EMBODIMENTS

Hereinafter, embodiments of the present invention will be described with reference to the attached drawings.

First Embodiment

Figure 1:
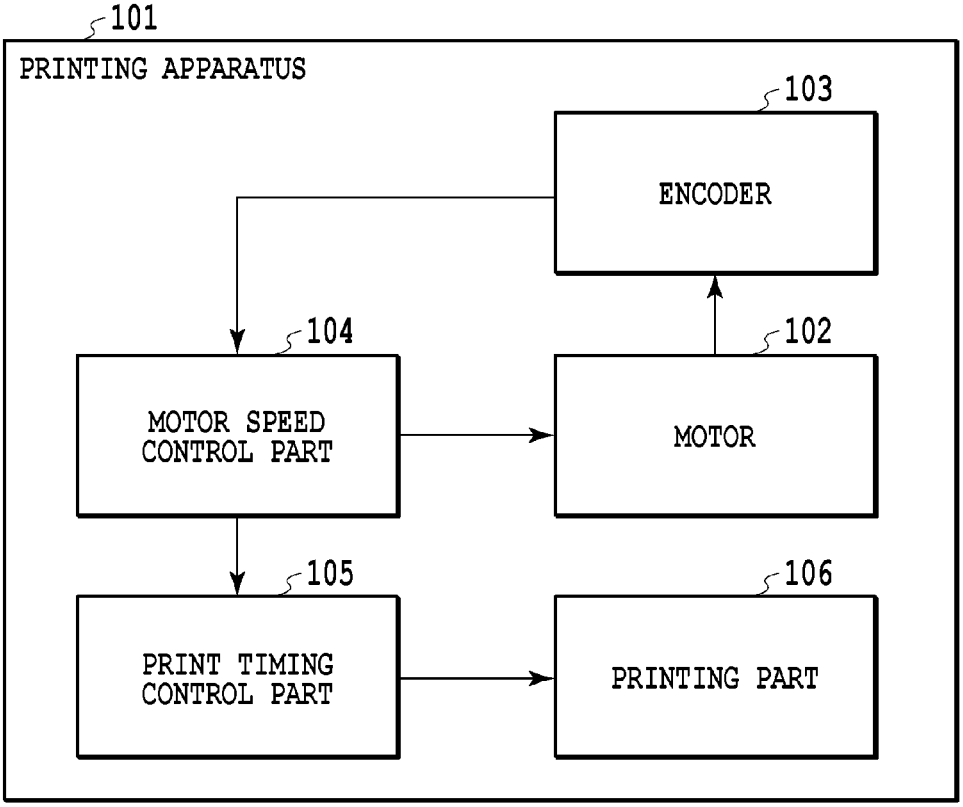
FIG. 1 is a block diagram showing the structure of print timing control of a printing apparatus according to one embodiment of the present invention.

FIG. 1 is a block diagram showing the structure of print timing control of a printing apparatus according to one embodiment of the present invention. A printing apparatus 101 according to the present embodiment is a serial-type printing apparatus for printing by moving a print head to scan a print medium such as a print sheet. A print head is an ink-jet print head for printing on a print medium by ejecting ink droplets from an ejection port. The printing apparatus 101 has a motor 102 that serves as a driving mechanism for moving a carriage having the print head mounted thereon. A motor speed control part 104 controls driving of the motor 102 based on detection information inputted from an encoder 103 for detecting a moving speed of the carriage, and as will described later with reference to FIG. 3 and others, provides various control parameters for a print timing control part 105. A printing part 106 having the print head causes the print head to eject ink at a timing specified by the print timing control part 105 during scanning of the print head to perform printing. Incidentally, the motor speed control part 104 and the print timing control part 105 shown in FIG. 1 are achieved by a control structure such as a CPU in the printing apparatus, and the printing part 106 has a mechanism for the print head and its movement.

Figure 11:
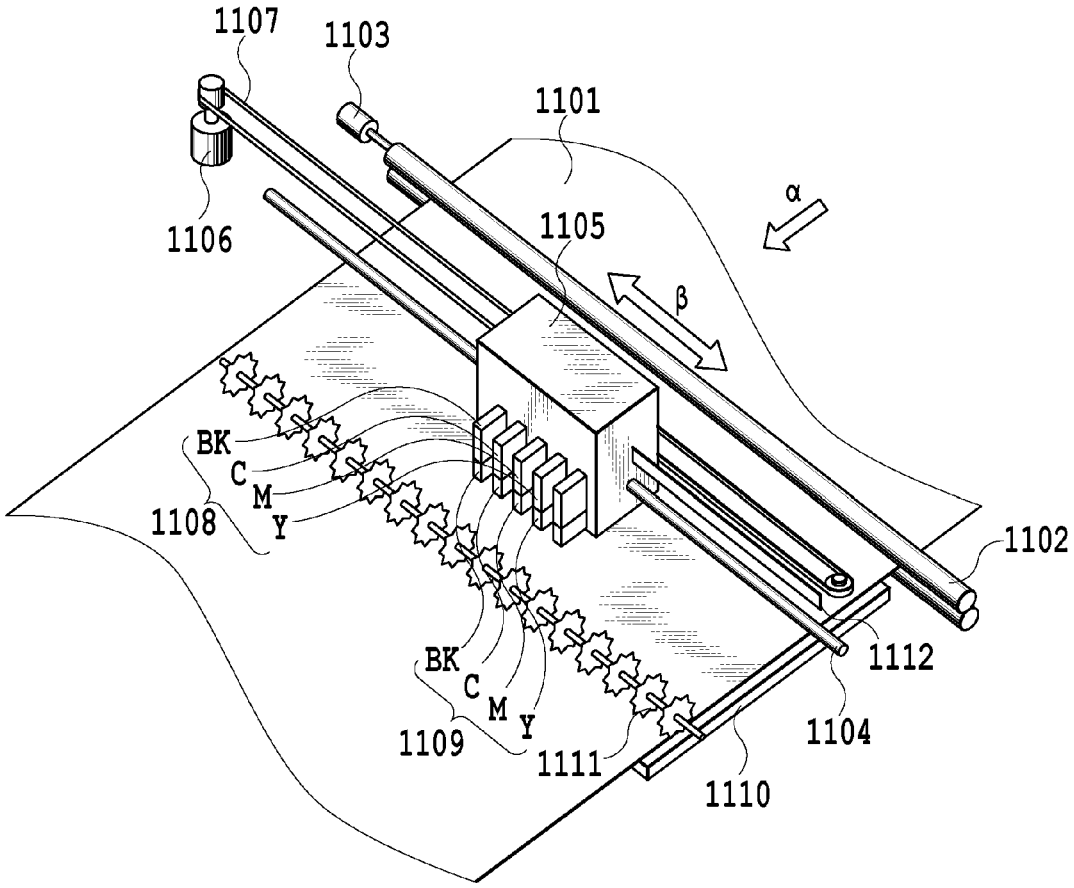
FIG. 11 is a perspective view of a printing apparatus according to a first embodiment of the present invention.

FIG. 11 is a perspective view of the printing apparatus according to the first embodiment of the present invention. In FIG. 11, a print medium 1101 is supported by print medium feeding rollers 1102 provided in a print area, ribs on a platen 1110, and spurs 1111, and is conveyed by the feeding rollers 1102 that are driven by a sheet feeding motor 1103 in a sub-scanning direction as shown by an arrow α. In front of the feeding rollers 1102, there is provided a shaft 1104 in parallel with the feeding rollers 1102. A carriage 1105 is movably guided by the shaft 1104 and reciprocally moves in a main scanning direction shown by an arrow β via a belt 1107 based on an output of a carriage motor 1106.

On the carriage 1105 serving as a print head moving unit, there are mounted print heads 1108 and tanks 1109 for storing print ink.

The moving speed of the carriage motor 1106 is measured by an encoder 1112.

The carriage motor 1106 and the encoder 1112 correspond to the motor 102 and the encoder 103 of FIG. 1, respectively.

Figure 2:
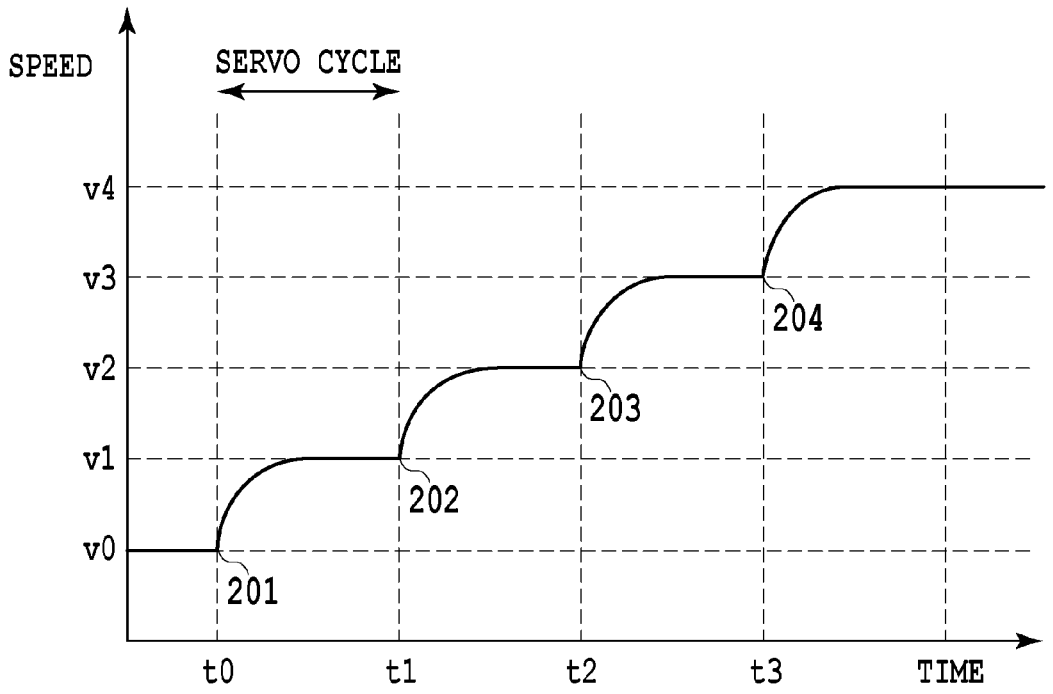
FIG. 2 is a graph showing exemplary motor driving control performed by a motor speed control part shown in FIG. 1.

FIG. 2 is a graph showing exemplary driving control for the motor 102 performed by the motor speed control part 104 and shows the relationship between an elapsed time and a moving speed of the print head (carriage) by the motor 102. The motor speed control part 104 performs servo control at a given cycle to control the speed of the motor 102. FIG. 2 shows control at the acceleration of carriage movement (print head scanning) and shows that the motor 102 is controlled by the motor speed control part 104 at every servo cycle that is a constant cycle. In FIG. 2, timings at which the motor speed control part 104 controls the motor 102 are set as 201(t0), 202(t1), 203(t2), and 204(t3). The motor speed control part 104 monitors that the moving speed of the print head is v0 based on an encoder signal received from the encoder 103 at the timing 201. Then, as will be described later, the motor speed control part 104 controls driving of the motor 102 on the basis of two parameters: a current speed v0 of the print head as monitored by the motor speed control part 104 and a control target speed v1 of the print head at the timing 201. In the same manner, the motor speed control part 104 controls the motor 102 on the basis of a target speed v2, a target speed v3, and a target speed v4, at the timing 202, the timing 203, and the timing 204, respectively. It should be noted that the change in moving speed of the motor 102 and the change in moving speed of the print head from a certain control timing to the next control timing vary depending on the characteristics and the structure of the printing apparatus.

Figure 3:
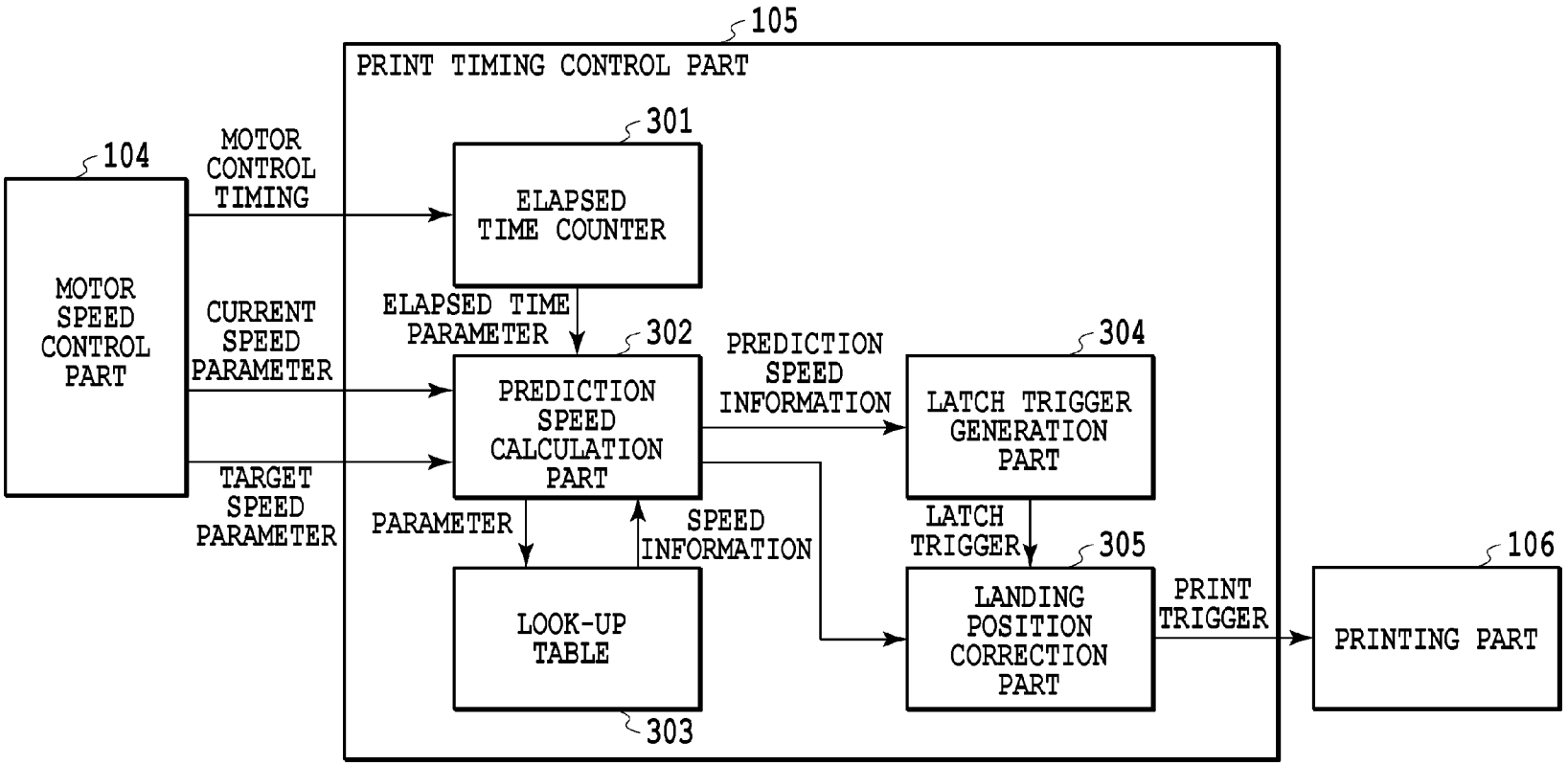
FIG. 3 is a block diagram showing a detailed structure of a print timing control part shown in FIG. 1.

FIG. 3 is a block diagram showing a detailed structure of the print timing control part 105. The print timing control part 105 is configured by using an elapsed time counter 301, a prediction speed calculation part 302, a look-up table 303, a latch trigger generation part 304, and a landing position correction part 305.

The print timing control part 105 receives a motor control timing signal from the motor speed control part 104. The print timing control part 105 also receives a current speed parameter and a target speed parameter which are used for the control of the motor 102 by the motor speed control part 104 from the motor speed control part 104, for each motor control timing. The elapsed time counter 301 of the print timing control part 105 counts the time from when the motor control timing signal is received, and passes the result to the prediction speed calculation part 302 as an elapsed time parameter. The prediction speed calculation part 302 receives a current speed parameter and a target speed parameter from the motor speed control part 104 and an elapsed time parameter from the elapsed time counter 301. With reference to the look-up table 303 based on the parameters, the prediction speed calculation part 302 calculates a prediction speed and outputs the result as prediction speed information to the latch trigger generation part 304 and the landing position correction part 305. Based on the prediction speed information, the latch trigger generation part 304 outputs a latch trigger to the landing position correction part 305 so as to control cycles at which the printing apparatus 101 performs printing. The landing position correction part 305 delays a latch trigger timing generated by the latch trigger generation part 304 based on the prediction speed information so as to generate and output a print trigger, that is, a timing at which the printing apparatus 101 performs printing, to the printing part 106.

Figure 4:
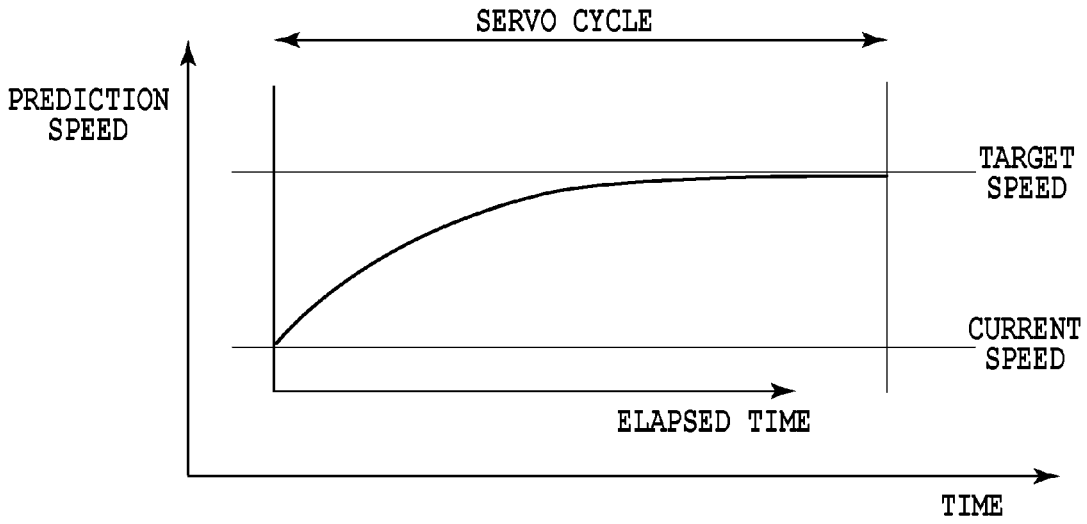
FIG. 4 is a graph used for explaining the content of a look-up table shown in FIG. 3.

FIG. 4 is a graph used for explaining the content of the look-up table 303. The look-up table 303 is used for obtaining a prediction speed based on three parameters: an elapsed time parameter, a target speed parameter, and a current speed parameter. More specifically, the table defines a prediction speed for each combination of a current speed, an elapsed time, and a target speed. Accordingly, among the combinations, a pair of a current speed detected at a motor control timing for each servo cycle and a target speed with respect to an elapsed time is determined, and a prediction speed corresponding to the determined pair is obtained. FIG. 12 shows an exemplary look-up table for obtaining a prediction speed. A prediction speed is obtained based on three parameters: a current speed obtained at a timing of a servo cycle, a target speed, and a time elapsed from the timing of a servo cycle. In FIG. 12, parameter values corresponding to the current speed, the target speed, the elapsed time, and the prediction speed are stored in a horizontal row of the table. FIG. 12 shows that the prediction speed parameter is 13 in a case where the current speed parameter is 10, the target speed parameter is 20, and the elapsed time parameter is 1. The prediction speed parameter is 15 in a case where the current speed parameter is 10, the target speed parameter is 20, and the elapsed time parameter is 4.

Incidentally, the look-up table is created in advance on the basis of the characteristics of the motor 102 and the structure of the printing apparatus 101. The look-up table may be set for each type of apparatus or for each apparatus in view of errors of the motor 102 and the printing apparatus 101. Further, an ink level parameter may also be used in a case where weight variations due to the ink level affect the characteristics.

Figure 5:
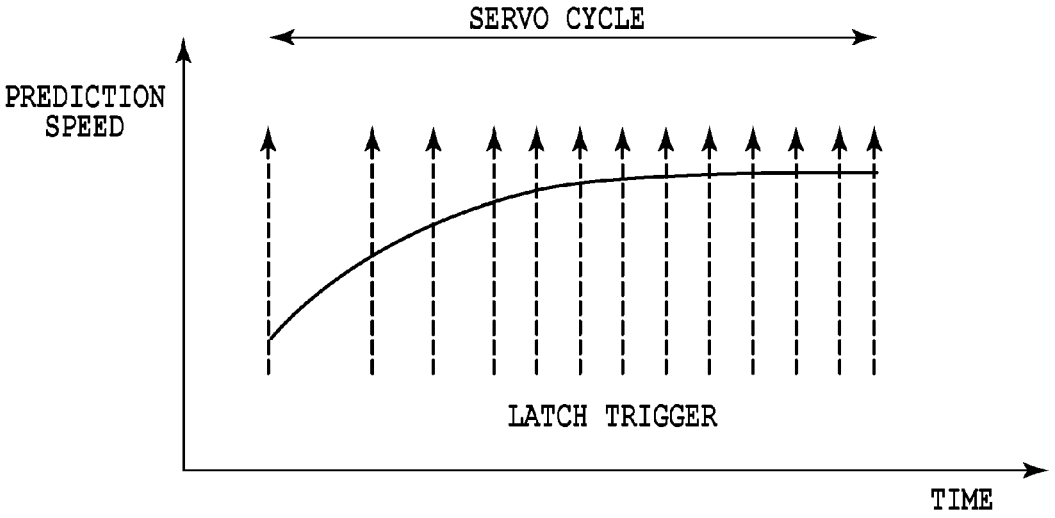
FIG. 5 is a graph showing the relationship between a prediction speed and a latch trigger cycle generated by a latch trigger generation part shown in FIG. 3.

Referring back to FIG. 3, the latch trigger generation part 304 controls latch trigger cycles so that a space between ink dots formed on a print medium is constant based on the prediction speed. As shown in FIG. 5, the latch trigger generation part 304 makes the latch trigger cycle smaller as the prediction speed in one of the servo cycles increases, whereas the latch trigger generation part 304 makes the latch trigger cycle larger as the prediction speed in one of the servo cycles decreases.

Figure 6:
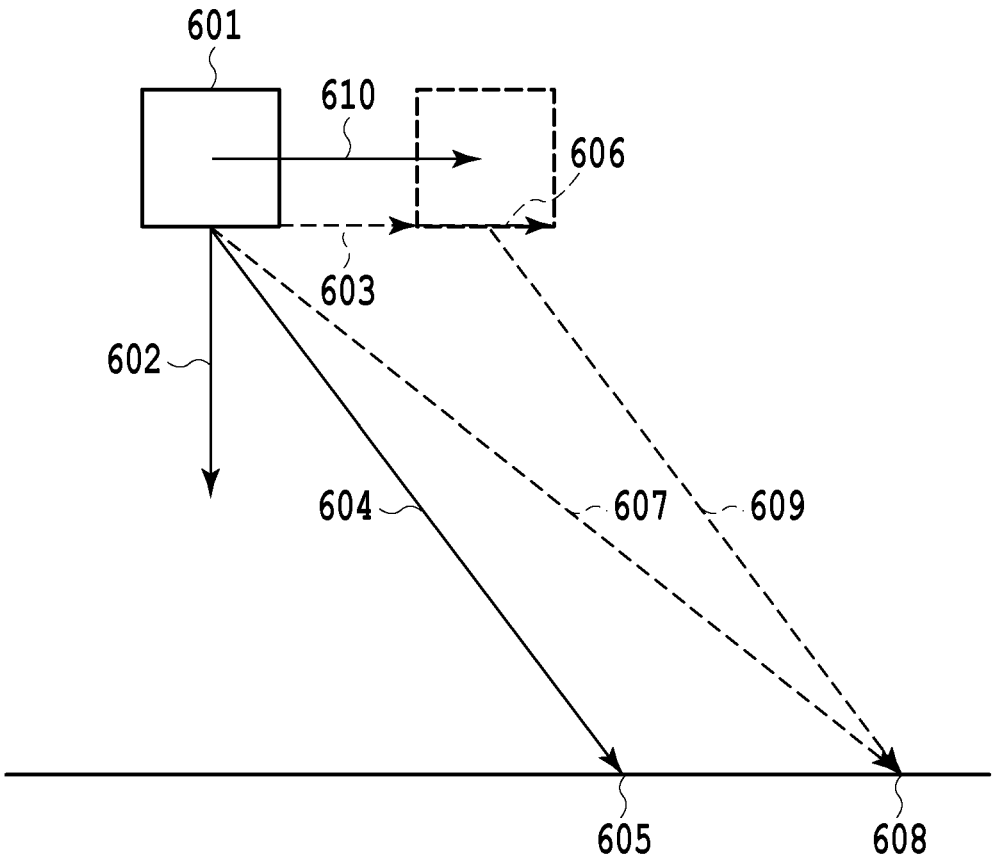
FIG. 6 is a diagram illustrating landing correction processing performed by a landing correction part shown in FIG. 3.

FIG. 6 is a diagram illustrating landing correction processing performed by the landing correction part 305 based on the prediction speed thus obtained.

In FIG. 6, ink from a print head 601 is ejected at an ejection speed 602. In a case where a moving speed of the print head is set as a speed 603, the ejected ink moves according to a resultant speed of the speed 602 and the speed 603. As a result, the ink passes through a passage 604 and lands in a position 605. In a case where a reference speed of the print head is set as a speed 606, the ink moves according to a resultant speed of the speed 602 and the speed 606 while the print head moves at a reference speed, and the ink passes through a passage 607 and lands in a target landing position 608. In other words, an error of the landing position occurs since an expected landing position is the position 608, whereas an actual landing position is the position 605. In the present embodiment therefore, landing is delayed by a time 610 so as to correct the error of the landing position caused by the moving speed of the print head. As a result, the ejected ink passes through a passage 609 and lands in the position 608. In this manner, the landing position correction part 305 obtains the delay time 610 based on the inputted prediction speed which is set as the speed 603. Then, by delaying the inputted latch trigger timing by the obtained time, the landing position correction part 305 generates a print trigger. Incidentally, the "reference speed" of the print head is a speed of the print head in scanning determined based on, for example, driving frequencies and a print resolution of the print head.

Figure 7A:
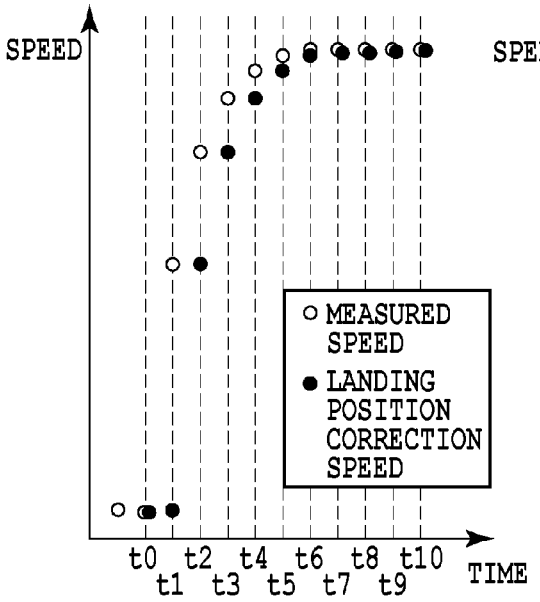
FIG. 7A and FIG. 7B show the relationship between an actual speed (measured speed) and a prediction speed (landing position correction speed) according to the prior art.
Figure 7B:
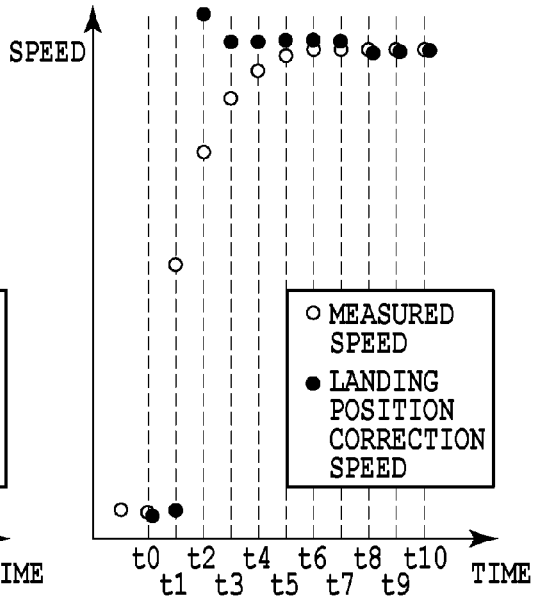
Figure 7C:
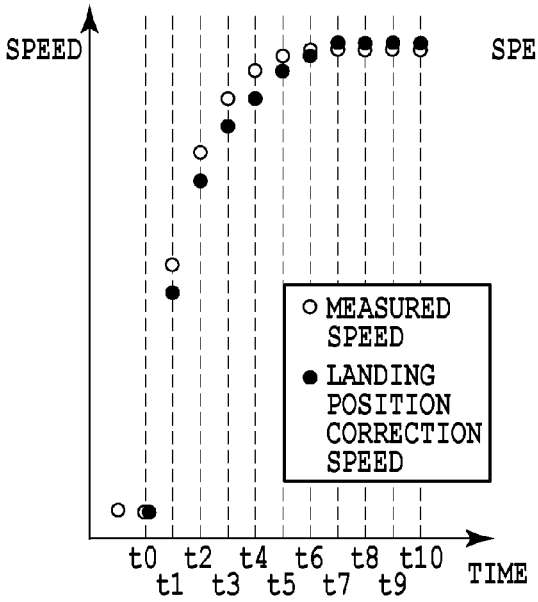
FIG. 7C and FIG. 7D show the relationship between an actual speed (measured speed) and a prediction speed (landing position correction speed) according to an embodiment of the present invention.
Figure 7D:
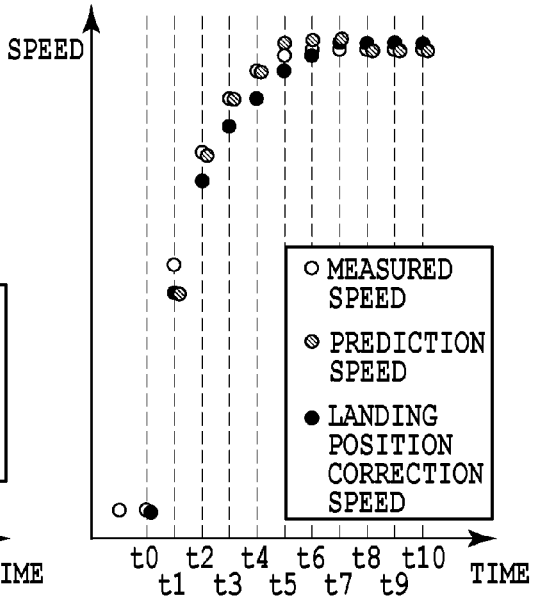

FIGS. 7A and 7B show the relationship between an actual speed (measured speed) and a prediction speed (landing position correction speed) according to the prior art, and FIGS. 7C and 7D show the relationship between an actual speed (measured speed) and a prediction speed (landing position correction speed) according to an embodiment of the present invention.

FIGS. 7A and 7B show landing correction according to the prior art, which are represented by prior art landing correction A and prior art landing correction B, respectively. FIG. 7C shows landing correction according to the present embodiment. As shown in FIGS. 7A and 7B, the prior art landing correction A uses a measured speed of a last cycle as a landing position correction speed. Meanwhile, as a landing position correction speed, the prior art landing correction B uses a speed at which a difference between the measured speed of the last cycle but one and the measured speed of the last cycle is equal to a difference between the landing position correction speed and the measured speed of the last cycle. In a case where a measured speed at a time t is set as vm(t) and a landing position correction speed at a time t is set as vc(t), the landing position correction speed obtained by the prior art landing correction A is represented by vc(tn)=vm(tn−1). Meanwhile, the landing position correction speed obtained by the prior art landing correction B is represented by vc(tn)=vm(tn−1)+(vm(tn−1)−vm(tn−2)).

On the other hand, according to the present embodiment, in a case where a prediction speed at a time t to be inputted to the landing position correction part 305 is set as vp(t), the landing position correction speed is represented by vc(tn)=vp(tn). More specifically, as described with reference to FIG. 6, the prediction speed is equal to the landing position correction speed. Accordingly, as shown in FIGS. 7A and 7B, according to the prior art landing correction, when a change in speed is large, as at time t1, t2, or t3, as the difference between the actual speed and the prediction speed increases, the land error increases. On the other hand, as shown in FIG. 7C, according to the landing correction of the present embodiment, the landing error can be reduced by setting the table as described with reference to FIG. 4.

Second Embodiment

Figure 8:
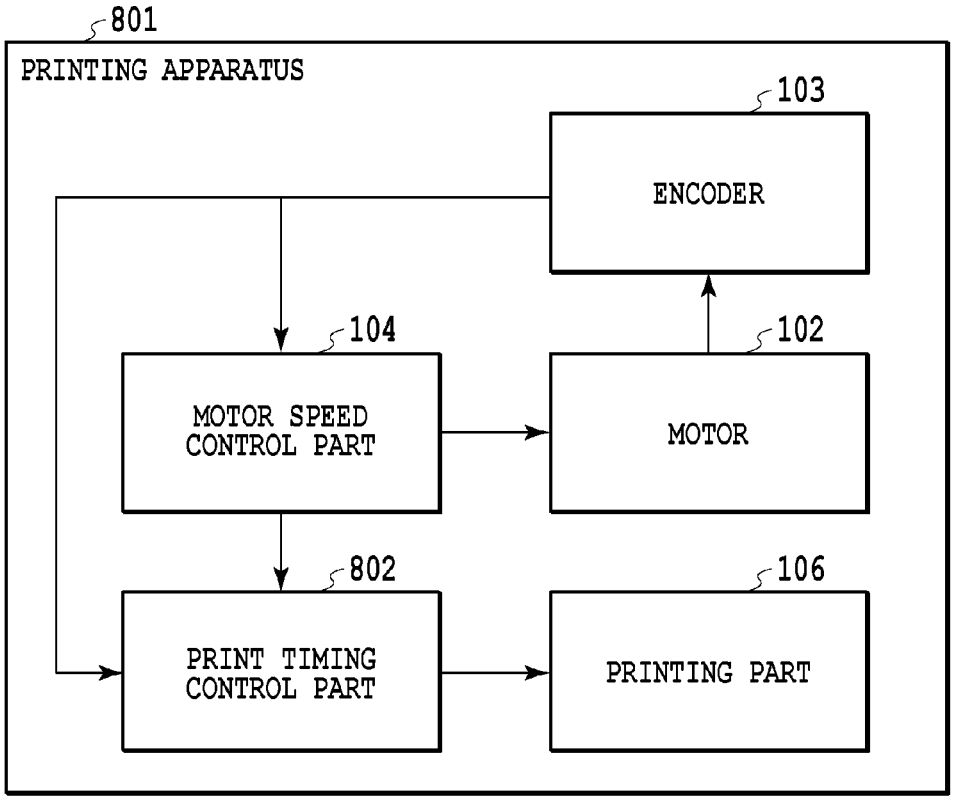
FIG. 8 is a block diagram showing the structure of print timing control of a printing apparatus according to a second embodiment of the present invention.

FIG. 8 is a block diagram showing the structure of print timing control of a printing apparatus according to a second embodiment of the present invention. The difference between the present embodiment and the first embodiment is that a signal from an encoder 103 is directly sent to a print timing control part 802 in the second embodiment.

Figure 9:
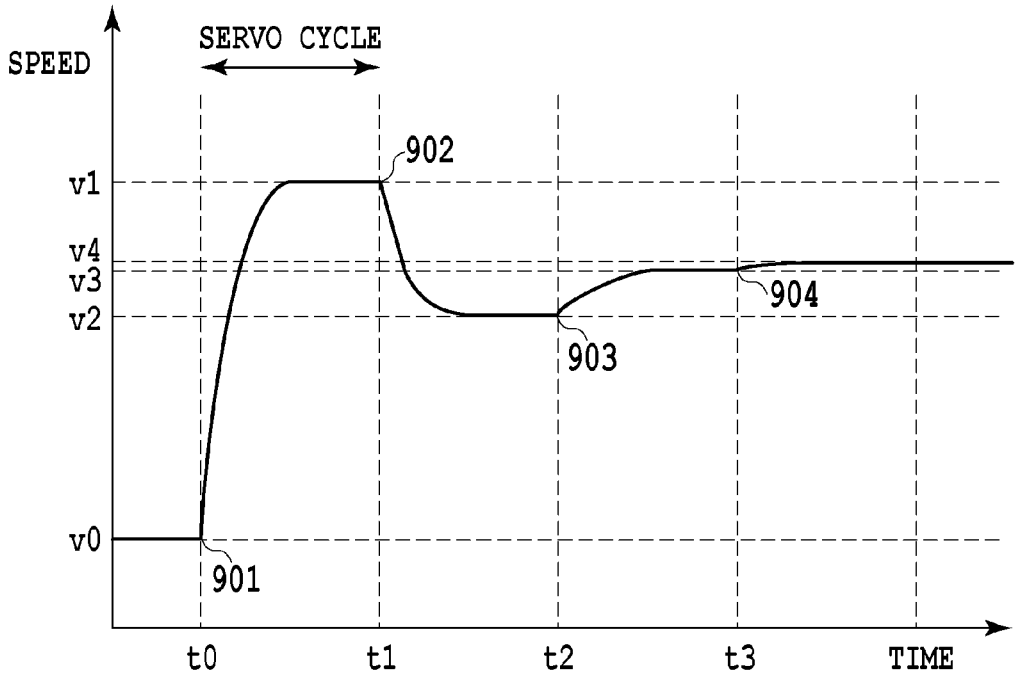
FIG. 9 is a graph showing exemplary motor driving control performed by a motor speed control part shown in FIG. 8.

FIG. 9 is a graph showing exemplary driving control of a motor 102 performed by a motor speed control part 104 according to the present embodiment, and shows the relationship between an elapsed time at acceleration and a moving speed of a print head. The timings at which the motor speed control part 104 controls the motor 102 are set as 901(t0), 902(t1), 903(t2), and 904(t3). The motor speed control part 104 monitors that the moving speed of the print head is v0 based on an encoder signal received from the encoder 103 at the timing 901. Then, the motor speed control part 104 controls the motor 102 on the basis of two parameters: a current speed v0 of the print head as monitored and a target speed v4 of the print head at the timing 901. In the same manner, the motor speed control part 104 controls the motor 102 on the basis of the target speed v4 at the motor speed control timings 902, 903, and 904.

Figure 10:
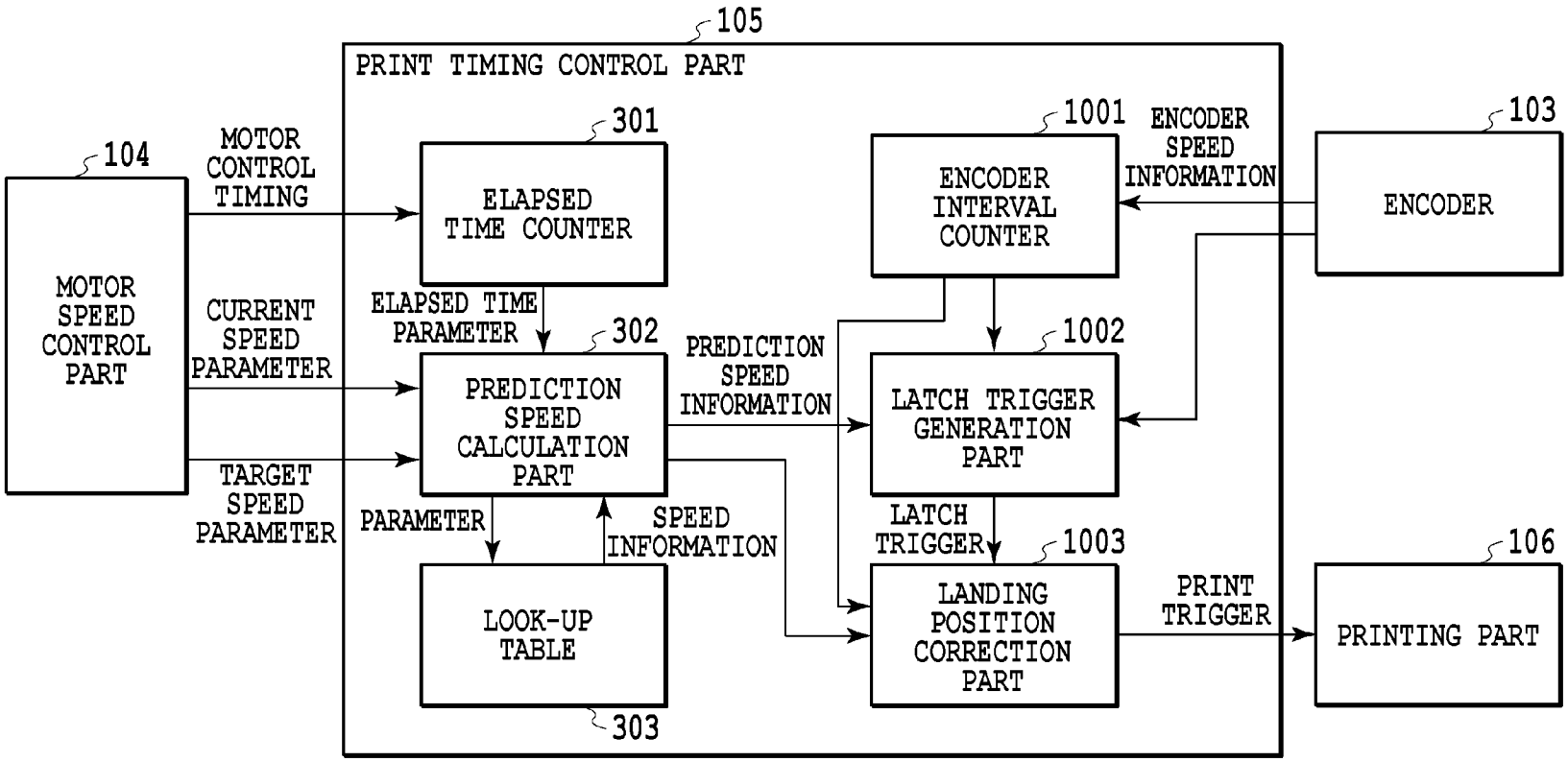
FIG. 10 is a block diagram showing a detailed structure of a print timing control part shown in FIG. 8.

FIG. 10 is a block diagram showing a detailed structure of the print timing control part 802 shown in FIG. 8. The print timing control part 802 is made up of an elapsed time counter 301, a prediction speed calculation part 302, a look-up table 303, an encoder interval counter 1001, a latch trigger generation part 1002, and a landing position correction part 1003. The encoder interval counter 1001 calculates a speed in an encoder section based on the information received from the encoder 103, and outputs the result to the latch trigger generation part 1002. The latch trigger generation part 1002 generates a latch trigger for each encoder section based on the encoder information received from the encoder 103. The landing position correction part 1003 predicts a speed based on the received prediction speed information and encoder speed information, performs landing position correction, and outputs a print trigger to a printing part 106.

FIG. 7D shows the relationship between an actual speed (measured speed) and a prediction speed (landing position correction speed) by the print timing control according to the present embodiment. In the present embodiment, a speed obtained by adding a difference between a prediction speed and a measured speed inputted at the previous timing to the landing position correction part 1003 to a prediction speed at a time t is used as a landing position correction speed. More specifically, the landing position correction speed of the present embodiment can be represented by vc(t)=vp(tn)+vm(tn−1)−vp(tn−1). As a result of the correction, the error of the prediction speed when the speed variation is large can be reduced, and the landing error can be reduced.

Figure 13:
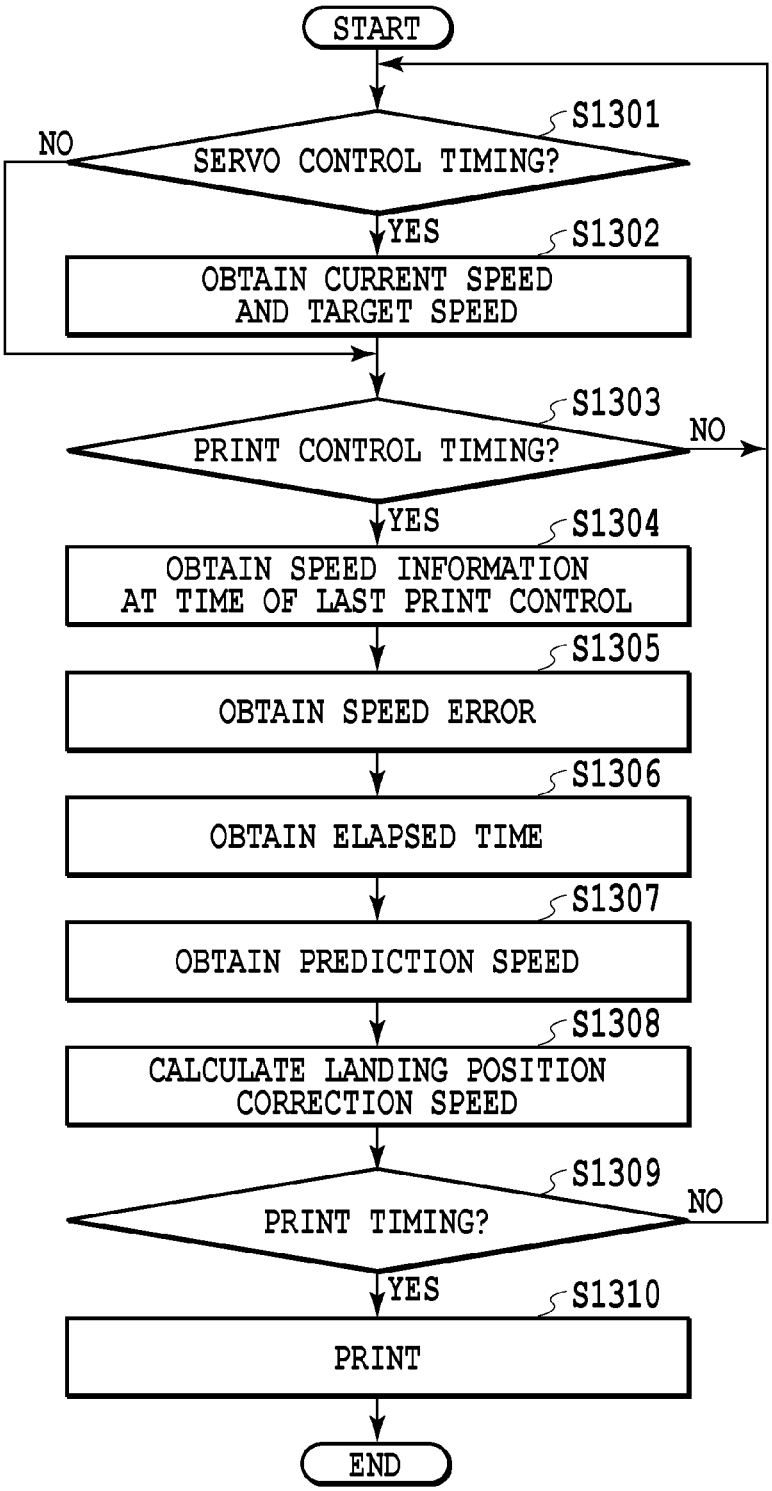
FIG. 13 is a flowchart of the print timing control shown in FIG. 7D.

FIG. 13 is a flowchart of the print timing control shown in FIG. 7D. At a servo control timing, that is, a control timing of the motor by the motor speed control part 104 (S1301), a print timing control part 105 obtains a current speed and a target speed from the motor speed control part 104 (S1302). Then, at a print control timing, that is, a timing in a cycle shorter than that of the servo control timing (S1303), the print timing control part 105 obtains speed information at the time of the last print control (S1304). The speed information at the time of the last print control is calculated such that the encoder 103 measures the travel distance of a carriage 1105 between the last print control timing and the current print control timing, and the result is divided by the last control cycle. The difference between the last speed information obtained in Step 1304 and the prediction speed used at the last print control timing is calculated, and a speed error is obtained (S1305). Further, with reference to the look-up table 303 and based on an elapsed time from the servo control timing of a current print control timing obtained in Step 1306 and the current speed parameter and the target speed parameter obtained in Step 1302, a prediction speed is obtained (S1307). Then, the speed error information obtained in Step 1305 is reflected on the prediction speed obtained in Step 1307, so that the landing position correction speed is calculated (S1308). The print timing control part 105 generates a print timing based on the landing position correction speed calculated in Step 1308. At the print timing generated by the print timing control part (S1309), the printing part 106 performs printing processing (S1310).

Other Embodiment

The above-described embodiments relate to the serial-type printing apparatus. However, the application of the present invention is not limited to these embodiments. The present invention is also applicable to a full line-type printing apparatus in which a print medium is conveyed with respect to a fixed print head. In this case, the moving speed of the print head is a relative moving speed that is a speed of the print medium conveyed with respect to the print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-127786, filed Jun. 18, 2013, which is hereby incorporated by reference herein in its entirety.

What is claimed is:

1. A printing apparatus comprising:

a relative movement unit configured to perform a relative movement between a print head and a print medium for printing on the print medium by the print head while relatively moving, a detection unit configured to detect a moving speed of the relative movement in a relative movement direction by the relative movement unit at a predetermined timing;

a moving control unit configured to control the relative movement between the print head and the print medium based on the detected speed of the relative movement and a target speed of the relative movement so that the relative movement is performed at a speed that is made closer to the target speed; and a timing control unit configured to obtain a prediction speed which is a speed predicted at a timing after the predetermined timing at which the moving speed is detected based on the detected moving speed and the target speed and control a print timing of the print head based on the prediction speed.

2. The printing apparatus according to claim 1, wherein from variations of the prediction speed determined based on the detected moving speed and the target speed at a control timing by the driving control unit, the timing control unit obtains the prediction speed corresponding to an elapsed time from the control timing.

3. The printing apparatus according to claim 1, wherein the timing control unit corrects the print timing by a time corresponding to the prediction speed.

4. The printing apparatus according to claim 1, wherein the timing control unit corrects the print timing by a time corresponding to a speed obtained by adding to the prediction speed a difference between the detected moving time and the target speed at a print timing previous to the print timing.

5. The printing apparatus according to claim 1, wherein the timing control unit controls the print timing of the print head based on the prediction speed so that the greater the prediction speed is, the printing timing is made faster.

6. The printing apparatus according to claim 1, wherein the timing control unit obtains the prediction speed corresponding to the detected moving speed and the target speed in a relation of the prediction speed to the moving speed and the target speed, the relation being preliminary determined.

7. The printing apparatus according to claim 1, wherein the relative movement unit performs the relative movement to move the print head with respect to the print medium at rest.

8. The printing apparatus according to claim 1, further comprising a conveying unit configured to convey the print medium in a direction intersecting the relative movement direction.

9. The printing apparatus according to claim 1, wherein the print head is a head for ejecting ink.

10. A print timing control method for performing printing by moving a print head relative to a print medium, the print timing control method comprising:

a detection step for detecting a moving speed of the relative movement in a relative movement direction at a predetermined timing;

a moving control step for controlling the relative movement between the print head and the print median based on the detected speed of the relative movement and a target speed of the relative movement so that the relative movement is performed at a speed that is made closer to the target speed; and a timing control step for obtaining a prediction speed which is a speed predicted at a timing after the predetermined timing at which the moving speed is detected based on the detected moving speed and the target speed and control a print timing of the print head based on the prediction speed.

11. The printing apparatus control method according to claim 10, wherein the print timing of the print head is controlled based on the prediction speed so that the greater the prediction speed is, the printing timing is made faster.

12. The printing apparatus control method according to claim 10, wherein the prediction speed corresponds to the detected moving speed and the target speed in a relation of the prediction speed to the moving speed and the target speed, the relation being preliminary determined.

13. The printing apparatus control method according to claim 10, wherein the relative movement moves the print head with respect to the print medium at rest.

* * * * *